US005975147A

United States Patent [19]

King et al.

[11] Patent Number: 5,975,147

[45] Date of Patent: Nov. 2, 1999

[54] HEDDLE FRAME WITH ADJUSTABLE CENTER BRACE ASSEMBLY

[75] Inventors: Michael T. King, Williamston; C. Keith Johnson, Greer, both of S.C.

[73] Assignee: Steel Heddle Manufacturing Compmay, Greenville, S.C.

[21] Appl. No.: 09/104,840

[22] Filed: Jun. 25, 1998

[51] Int. Cl.[6] ..... D03C 9/06

[52] U.S. Cl. ..... 139/91; 411/103; 403/346

[58] Field of Search ..... 139/91; 403/346; 411/103

[56] References Cited

U.S. PATENT DOCUMENTS

| | | | |
|---|---|---|---|
| 2,905,204 | 9/1959 | Kaufmann . | |
| 2,909,199 | 10/1959 | Kaufmann | 139/91 |
| 2,944,571 | 7/1960 | Pfarrwaller . | |
| 3,889,721 | 6/1975 | Wagner . | |
| 4,298,771 | 11/1981 | Olashaw | 403/346 |
| 4,924,916 | 5/1990 | Faasse et al. | 139/91 |
| 5,332,006 | 7/1994 | Gaisser | 139/91 |
| 5,560,399 | 10/1996 | Kramer | 139/91 |
| 5,630,448 | 5/1997 | Faasse | 139/91 |

FOREIGN PATENT DOCUMENTS

| | | |
|---|---|---|
| 1375880 | 2/1965 | France . |
| 371413 | 9/1963 | Switzerland . |

*Primary Examiner*—Andy Falik
*Attorney, Agent, or Firm*—Dority & Manning

[57] ABSTRACT

A heddle frame includes a top rail and a bottom rail connected at their ends with end members to form a rectangular frame. An adjustable center brace assembly extends between the top and bottom rails, and includes an elongated brace extending through the top rail with a bottom end adjustably and lockingly engaged with the bottom rail. The brace may have a multi-sided head at the top thereof configured to be engaged by a conventional driving tool. A locking block is disposed over the multi-sided head and is a removably attached to the top rail. The locking block has a recess defined in the underside thereof with a width corresponding generally to that of the multi-sided head for rotationally locking the head and center brace. The head of the brace has a width so as not to extend beyond the sides of the top rail, and the head can be rotated with a conventional driving device without removal of the heddle frame from the textile machine, or interfering with adjacent heddle frames.

14 Claims, 3 Drawing Sheets

HEDDLE FRAME WITH ADJUSTABLE CENTER BRACE ASSEMBLY

BACKGROUND OF THE INVENTION

The present invention relates to a heddle frame for a loom, and in particular to an improved heddle frame having a center brace for maintaining parallelism between the top and bottom rails of the heddle frame.

A known heddle frame with an improved center brace assembly is disclosed in U.S. Pat. No. 4,924,916. In this patent, the heddle frame comprises top and bottom rails which are typically made of extruded aluminum, as commonly understood in the art. The top and bottom rails are connected to each other at their ends by end struts or members to provide a rigid connection between the rails and to define a generally rectangular harness or heddle frame. The frame includes top and bottom heddle supporting rods or rails upon which the heddles are slidably mounted, as is commonly understood in the art. A center brace is mounted midway between the ends of the frame, and in some cases a plurality of braces may be employed. The center brace serves to prevent distortion of the frame and to maintain the parallel relationship between the top and bottom rails.

In the '916 patent, the center brace extends through an opening into the top rail and into an opening in the bottom rail. A top sleeve is disposed in an opening in the top rail and extends about the center brace to separate the brace from the opening in the top rail. Likewise, a bottom sleeve is disposed on the bottom rail and is threaded onto the center brace. Means are provided on the upper surface of the top rail to secure and retain the center brace within the opening.

U.S. Pat. No. 5,630,448 describes an embodiment of a heddle frame having a center brace assembly wherein the center brace extends between the top rail and the bottom rail. First and second locking blocks are attached to the top rail and the bottom rail and are configured to respectively receive a first flange at one end of the center brace and a second flange at the opposite end of the center brace, and to exert forces on the first and second flanges to create opposing torques thereon. This generates a torque on the center brace and thus locks the first flange and the second flange within their respective locking blocks.

U.S. Pat. No. 2,909,199 describes an early embodiment of a heddle frame incorporating a center brace assembly wherein the center brace or rod is threaded to a head piece. The head piece is seated in a recess of a member bolted to the top rail. A locking member is superposed on this recessed member. The locking member has a recess on its underside in which the head piece is positioned whereby rotation of the rod or center brace is prevented when the locking member is in its operative position.

One drawback with the known center brace assemblies is that the adjusting mechanism extends laterally beyond the width of the heddle frames and thus interferes with adjacent heddle frames. Thus, adjustment of one heddle frame is impeded by and may actually cause misalignment of adjacent heddle frames, and so forth.

The present invention provides an improved center brace assembly for heddle frames that can be vertically adjusted without interfering with adjacent heddle frames.

OBJECTS AND SUMMARY OF THE INVENTION

It is thus a principal object of the present invention to provide an improved heddle frame having an adjustable center brace assembly.

Additional objects and advantages of the invention will be set forth in part in the following description, or may be obvious from the description, or may be learned through practice of the invention.

In accordance with the objects and purposes of the invention, a heddle frame for supporting a plurality of heddles is provided. The heddle frame has a top rail and a bottom rail, and end members that connect the top and bottom rails to form a generally rectangular frame structure. Top and bottom heddle bars are longitudinally supported on the frame structure for supporting heddles within the heddle frame. An adjustable center brace assembly extends between the top rail and the bottom rail intermediate of the end members. This center brace assembly maintains parallelism between the top and bottom rails. The center brace assembly includes an elongated brace that extends through the top rail with a bottom end that is adjustably and lockingly engaged with the bottom rail. The brace includes a top end having a rotatable head with a width that is configured to be engaged and rotated by a drive tool without contacting adjacent heddle frames. For instance, a multi-sided head may be used that has a width less than the width of the top rail. The head may also, for example, use a conventional hex recess.

A locking block is disposed over the head and is removably attached to the top rail. The locking block includes a recess defined therein having a width that corresponds generally to that of the head.

In a locked configuration of the center brace assembly, the locking block is mounted to the top rail with the head residing within the recess of the locking block. This arrangement prevents rotation of the head and center brace. In an adjusting configuration of the center brace, the locking block is removed from the top rail and the head is then free to be rotated for vertical adjustment of the center brace without interfering with adjacent heddle frames.

In a preferred embodiment, the bottom end of the center brace is threadedly engaged with the bottom rail so that rotation of the multi-sided head and center brace causes the bottom end to be threadedly adjusted relative to the bottom rail. In this embodiment, the bottom rail may include a nut block attached thereto for threaded engagement with the end of the center brace.

And in yet another preferred embodiment, the recess in the locking block may have a height that is slightly less than that of the head. With this configuration, when the locking block is bolted to the top rail at positions on each side of the recess, the locking block is caused to bow slightly and thus clamp at defined points against the head.

It may also be preferred that the center brace is slidable through the top rail up to the head. This makes for relatively easy insertion and replacement of the center brace in that it is not threadedly engaged with the top rail.

The present invention also relates to a unique center brace assembly for use with any conventional configuration of a heddle frame to maintain parallelism between the top and bottom rails of the heddle frame. The center brace assembly may be configured as described above.

DETAILED DESCRIPTION

Reference will now be made in detail to the presently preferred embodiments of the invention, one or more examples of which are illustrated in the accompanying drawings. Each example is provided by way of explanation of the invention, and not as a limitation of the invention. For example, various modifications and variations can be made in the present invention without departing from the scope or spirit of the invention. It is intended that the present invention cover such modifications and variations as come within the scope and spirit of the invention. Additionally, the numbering of components is consistent throughout the description and drawings, with the same components having the same number throughout.

Figure 1:
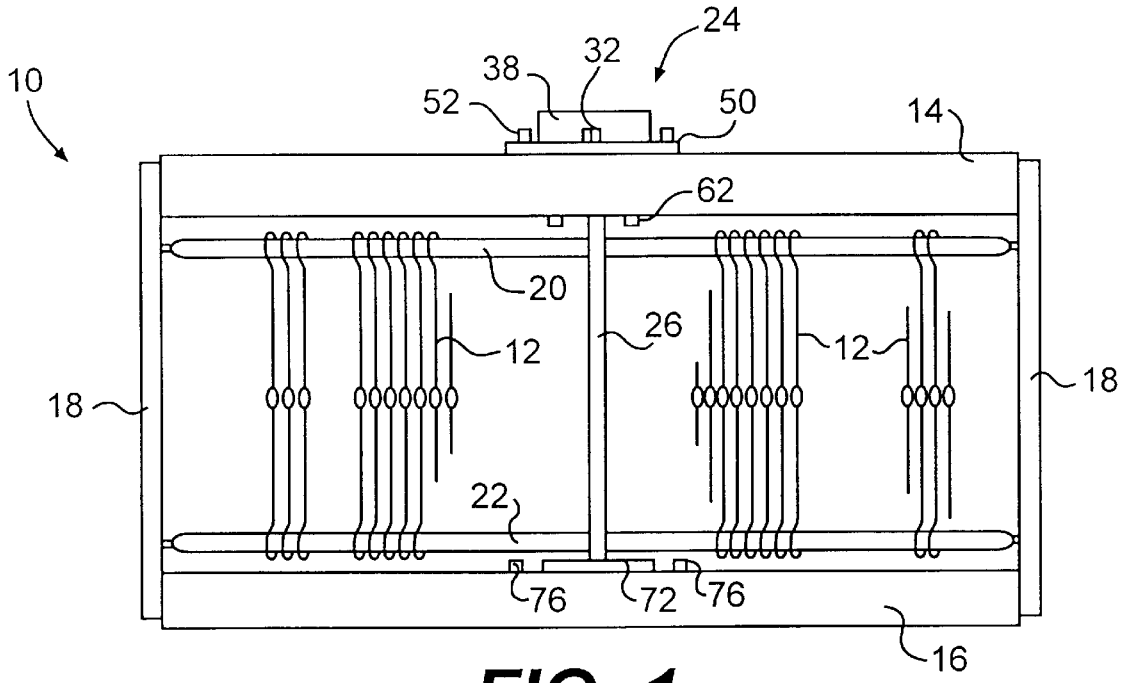
FIG. 1 is a front perspective view of a heddle frame according to the invention.
Figure 2:
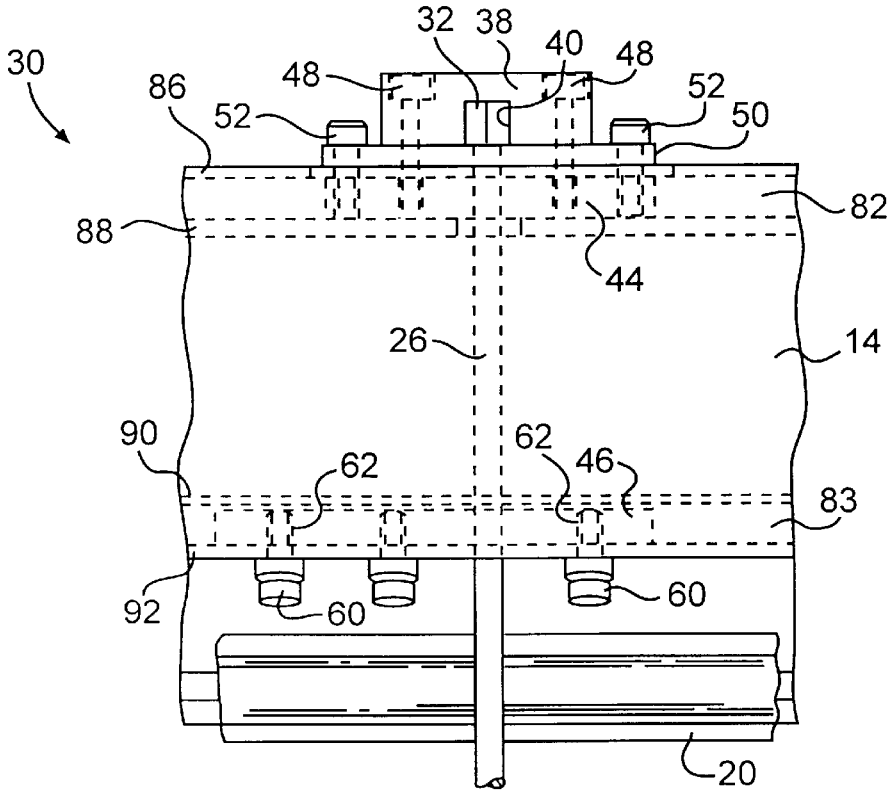
FIG. 2 is an enlarged perspective view of the top end of the center brace assembly according to the invention.

A heddle frame 10 is illustrated generally in FIG. 1. Heddle frame 10 comprises a top rail 14 and a bottom rail 16 which extend generally horizontally at a space distanced from each other. Frame 10 is completed by end members 18 joining top and bottom rails 14 and 16 at each of their ends to form a generally rectangular frame structure. Frame 10 also includes heddle bars 20, 22 on which are suspended a plurality of heddles 12, as is commonly understood in the art.

It should be appreciated that the present invention is not limited to any particular configuration of heddle frame beyond that just described. For example, various configurations of rectangular harness frames having top and bottom rails are known and commonly understood in the industry. Any such configuration of rectangular harness frames including top and bottom rails are within the scope and spirit of the invention.

Heddle frame 10 includes a center brace assembly, generally 24 in FIG. 1. Center brace assembly 24 includes an elongated center brace 26 connected to top rail 14 and bottom rail 16 to provide additional support for maintaining the top and bottom rails parallel to each other. Center brace assembly 24 has a top end configuration 30 and a bottom end configuration 28.

Figure 5:
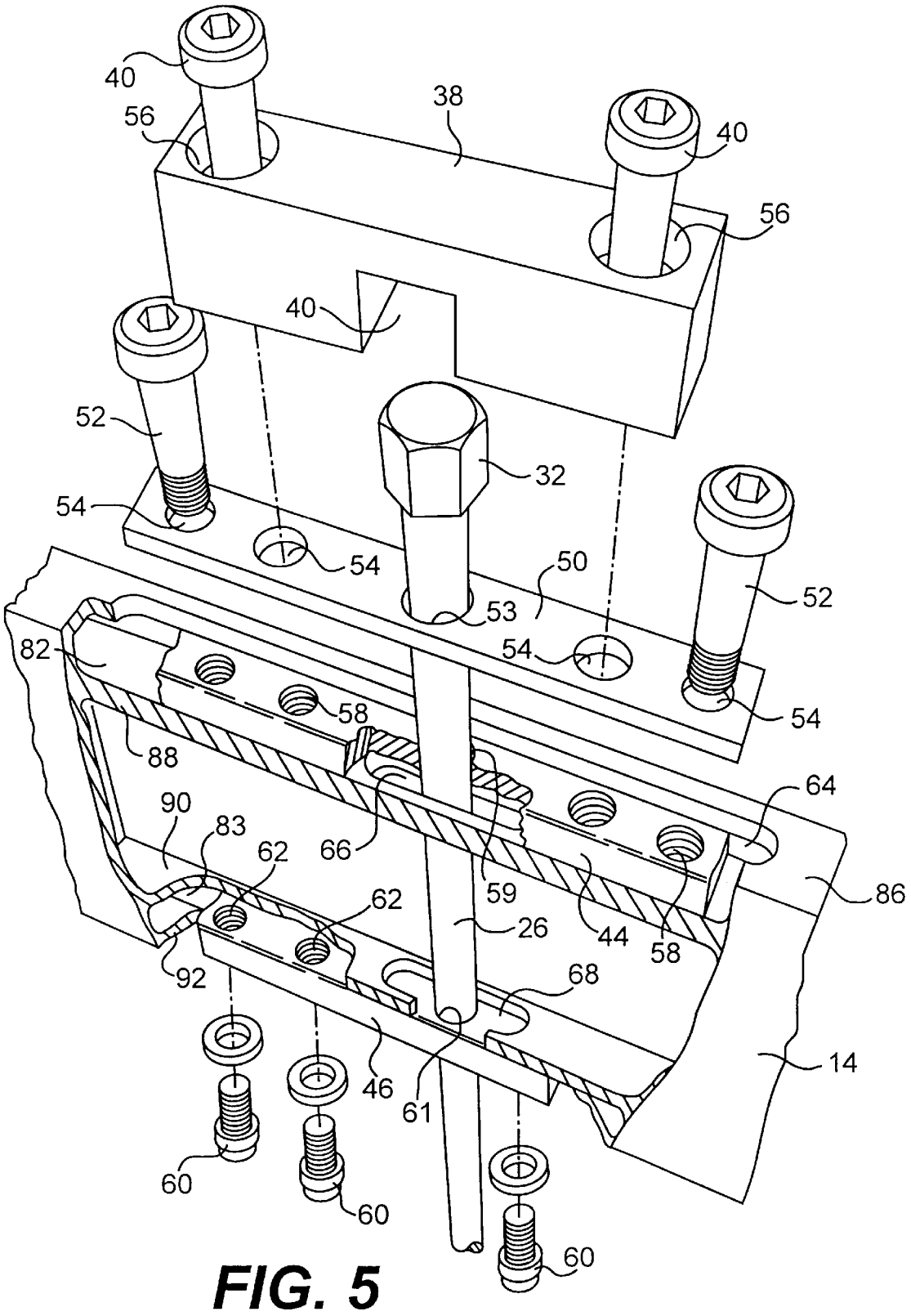
FIG. 5 is a partial cut-away in-line component view of the top end of the center brace assembly according to the invention.

Referring to the remaining figures in general, top end configuration 30 includes a head 32 formed integral on the top end of center brace 26. Head 32 may be multi-sided for purposes of rotating the head with a conventional tool, or may include a multi-sided recess defined in the top thereof, such as a hex bolt. In the embodiment illustrated, head 32 is a conventional hex-sided head. Brace 26 has a threaded end 42 at the opposite end of head 32. Center brace 26 drops through top rail 14 and is threadedly engaged with bottom rail 16. Referring to FIG. 5 in particular, center brace 26 extends through an elongated slot 64 defined in a top surface 86 of rail 14. Rail 14 includes rigid intermediate walls 88 and 90, top wall 86, and bottom wall 92. Walls 88, 90, 86, and 92 also have slots 66, 68, 64, and a slot (not visible in the figures) in bottom wall 92 formed therein so that brace 26 can pass completely through top rail 14. Slots 64, 66, and 68 may be elongated so that there is a degree of adjustment of the center brace horizontally along rails 14 and 16.

The top end assembly 30 of center brace assembly 24 also includes a insert nut block 44 that is disposed within a recess 82 defined between top surface or wall 86 and intermediate wall 88 of rail 14. Insert nut block 44 contains threaded holes or bores 58 which are engaged by bolts 52 extending through bores or holes 54 in a washer plate or strip 50 that is positioned on top of surface 86 of rail 14. Washer strip 50 also includes a bore 53 through which center brace 26 passes. Head 32 is sized so as not to pass through bore 53.

Top rail 14 also includes an insert rail guide 46 disposed in a space or recess 83 defined between intermediate wall 90 and bottom wall 92 of rail 14. Insert guide 46 is bolted to rail 14 by way of bolts 60 extending through bottom wall 92 and into threaded holes 62 defined in guide insert 46. Guide insert 46 also includes a passage or bore 61 through which center brace 26 extends.

It should be clear from FIG. 5 in particular that the center brace assembly 24 can be adjusted horizontally along the rails 14, 16 at least to the extent of elongation of slots 64, 66, and 68. For example, bolts 52 and 60 can be loosened so that the insert nut block 44 and insert guide block 46, with center brace 26 extending therethrough, can be slid horizontally within recesses 82, 83 respectively at least until center brace 26 abuts against either end of the shorter of the elongated slots 66, 68, or 64.

Figure 3:
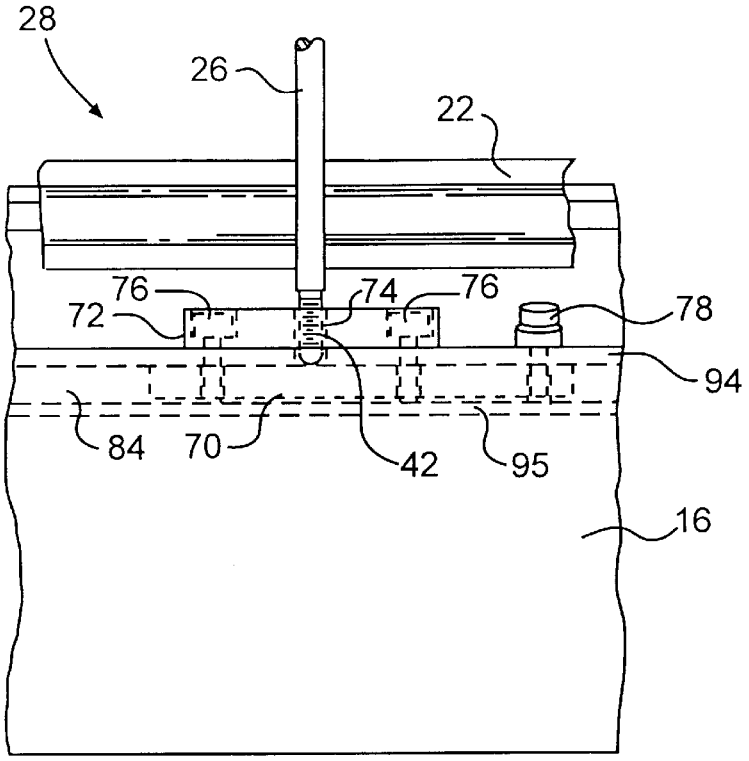
FIG. 3 is an enlarged perspective view of the bottom end of the center brace assembly according to the invention.

The bottom end assembly 28 of center brace assembly 24 is illustrated particularly in FIG. 3. Threaded end 42 of brace 26 is threadedly engaged in a threaded bore 74 defined in a bottom stay block 72. Bottom stay block 72 is bolted to bottom rail 16 by way of bolts 76 that extend into threaded bores defined in a bottom insert nut block 70. Bottom nut block 70 is disposed in a recess 84 between a top wall 94 and intermediate wall 95 of bottom rail 16. A bolt 78 fixes bottom nut block 70 within recess 84.

It should be understood that center brace 26 can be vertically adjusted to adjust parallelism between rails 14 and 16 by rotation of head 32, which causes threaded end 42 to threadedly advance in threaded bore 74.

Figure 4:
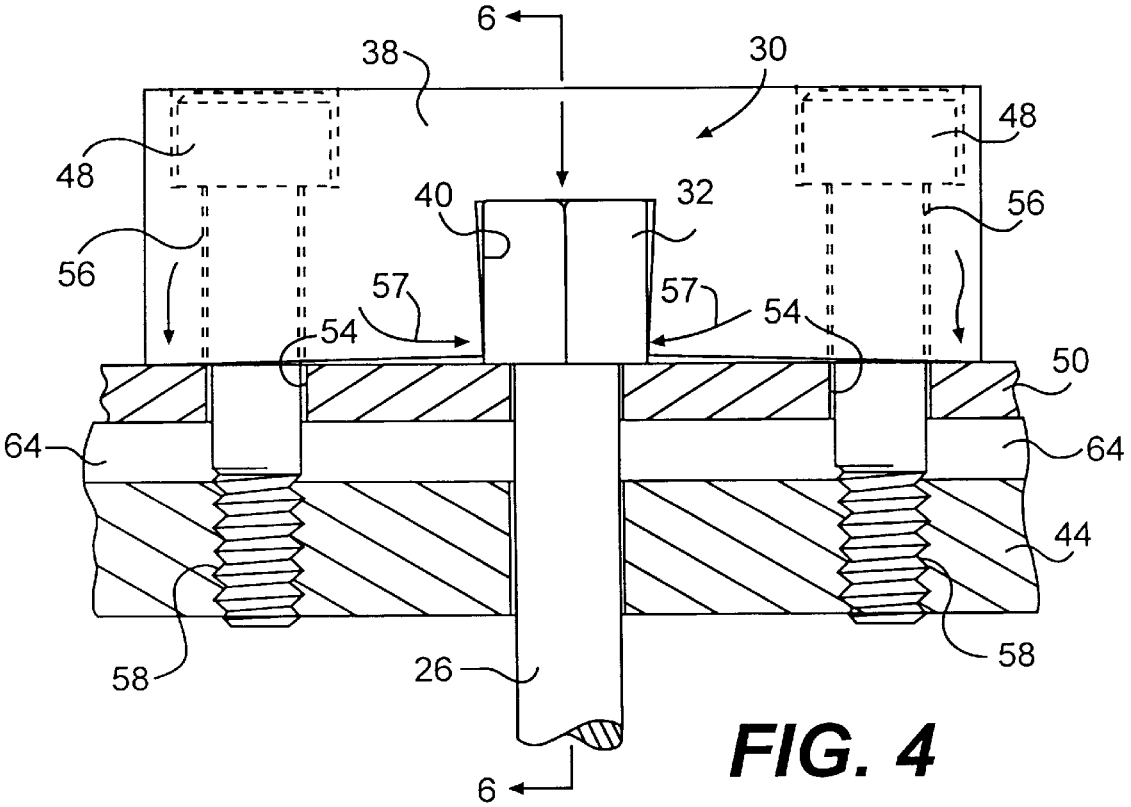
FIG. 4 is an enlarged cross-sectional view of the locking block assembly according to the invention.

In a locked configuration of the center brace assembly as illustrated in FIG. 4, a locking block 38 is disposed to rotationally lock head 32. Locking block 38 is bolted to top rail 14 by way of bolts 48 passing through holes 56 in locking block 38, passing through holes 54 in washer plate 50, and threadedly engaging in threaded bores 58 defined in upper nut block 44. Locking block 38 contains a recess 40 defined on the underside thereof. Recess 40 has a width that corresponds generally to that of head 32, and is preferably slightly greater than the width of head 32. In this regard, head 32 includes flat sides defined on the circumference thereof if a multi-sided configuration is not used so that head 32 is rotationally locked within recess 40. Additionally, recess 40 has a height or depth that is preferably slightly less than the height of head 32. Referring to FIG. 4 in particular, in order to rotationally lock center brace 26, locking block 38 is bolted into nut block 44 with bolts 48. Since head 32 has flat sides and has a width corresponding generally to that of recess 40, locking block 38 prevents rotation of head 32. In the embodiment wherein the width of recess 40 is slightly greater than the width of head 32 and the depth or height of recess 40 is slightly less than the height of head 32, an additional clamping force is generated on head 32 when bolts 48 are tightened completely down. For example, referring to FIG. 4, when bolts 48 are tightened down on each side of recess 40, the ends of clamping block 38 are drawn against the top surface of washer plate 50, as indicated by the arrows. Since the height of recess 40 is less than that of head 32, locking block 38 will have a tendency to bow slightly thus causing the bottom corners of recess 40 to pinch against the sides of head 32, as illustrated diagrammatically by arrows 57 in FIG. 4. This action generates an additional rotational-locking force on head 32.

To adjust or remove center brace 26, an operator merely releases bolts 48 and removes locking block 38. Since head 32 has a width generally less than that of rail 14 and is shaped to be received by a conventional driving tool, the operator can adjust or remove the center brace without removing heddle frame 10 from the loom, or contacting or otherwise interfering with adjacent heddle frames. This particular advantage of the present center brace assembly according to the invention is a marked improvement over prior art devices.

It will be apparent to those skilled in the art that various modifications and variations can be made in the present invention without departing from scope and spirit of the invention. For example, features illustrated or described as part of one embodiment can be included in another embodiment to yield a still further embodiment. It is intended that the present invention that the present invention cover such variations and modifications as come within the scope of the appended claims and their equivalents.

What is claimed is:

1. A heddle frame for supporting a plurality of heddles, said frame comprising:

a top rail and a bottom rail, and end members connecting said top rail and said bottom rail to form a generally rectangular frame structure therewith;

a top and a bottom heddle bar longitudinally supported on said frame structure for supporting heddles within said frame structure;

a vertically adjustable center brace assembly extending between said top rail and said bottom rail intermediate of said end members for maintaining parallelism of said top and bottom rails, said center brace assembly further comprising an elongated brace extending through said top rail and having a bottom end adjustably and lockingly engaged with said bottom rail, said brace comprising a top end having a head with a width sized to be engaged and rotated by a drive tool without contacting adjacent heddle frames;

a locking block disposed over said head and removably attached to said top rail, said locking block having a recess defined therein with a width corresponding generally to that of said head, and wherein in a locked configuration of said center brace assembly, said locking block is fixedly mounted to said top rail with said head residing within said recess of said locking block thereby preventing rotation of said head and brace by sides of said recess clamping against said head, and in an adjusting configuration of said center brace assembly said locking block is removed from said top rail and said head is rotatable for vertically adjusting said brace without interfering with adjacent heddle frames; and wherein said recess in said locking block has a height generally less than that of said head, and in said locking configuration said locking block is bolted to said top rail causing said locking block to bow and clamp against said head.

2. The heddle frame as in claim 1, wherein said bottom end of said brace is threadedly engaged with said bottom rail so that rotation of said head and brace causes said bottom end to threadedly adjust relative to said bottom rail.

3. The heddle frame as in claim 2, wherein said bottom rail comprises a nut block attached thereto, said bottom end of said brace threadedly engaged with said nut block.

4. The heddle frame as in claim 1, further comprising an insert nut block disposed within said top rail, said locking block removably bolted to said insert nut block.

5. The heddle frame as in claim 1, wherein said head has flat sides and a width generally not greater than that of said top rail.

6. The heddle frame as in claim 5, wherein said head is hex-shaped and has a widest width generally less than that of said top rail.

7. The heddle frame as in claim 1, wherein said brace is vertically slidable through at least two elongated slots in said top rail up to said head and is threadedly engaged with said bottom rail.

8. The heddle frame as in claim 1, wherein said top rail forms at least one elongated slot to allow said brace to be slidably movable horizontally along said rail.

9. A center brace assembly used to maintain parallelism between top and bottom rails of a heddle frame, said center brace assembly comprising:

an elongated brace having a length to connect between the top rail and bottom rail;

a threaded end defined on one end of said brace and a multi-sided head defined on an opposite end of said brace wherein said threaded end is adapted to be insertable through the top rail and variably threadedly engageable with the bottom rail;

a locking block adapted to be removably attachable to the top rail and having a recess defined therein of a height generally less than that of said multi-sided head for receiving said multi-sided head and causing said locking block to bow and clamp against said head in a locking configuration of said center brace assembly to rotationally lock said multi-sided head and brace relative to the top and bottom rails; and wherein said brace is vertically adjustable for maintaining parallelism of the top and bottom rails by rotation of said multi-sided head, and said multi-sided head has a width so as to be rotatable with a drive tool without contacting adjacent heddle frames.

10. The center brace assembly as in claim 9, wherein said locking block is adapted to be removably bolted to the top rail at positions on each side of said recess.

11. The center brace assembly as in claim 9, further comprising an insert nut block disposable within said top rail, said locking block removably boltable to said insert nut block.

12. The center brace assembly as in claim 9, wherein said multi-sided head has a width generally not greater than that of the top rail.

13. The center brace assembly as in claim 12, wherein said multi-sided head is hex-shaped and has a widest width generally less than that of said top rail.

14. The heddle frame as in claim 9, wherein said top rail forms at least one elongated slot to allow said brace to be slidably movable horizontally along said rail.

* * * * *